US005896788A

United States Patent [19]

Hreha et al.

[11] Patent Number: 5,896,788

[45] Date of Patent: Apr. 27, 1999

[54] HAMMER WITH IMPROVED HANDLE INTERLOCK AND METHOD OF MAKING SAME

[75] Inventors: Kenneth W. Hreha, Tullahoma; Frank Robinson, Shelbyville, both of Tenn.

[73] Assignee: The Stanley Works, New Britain, Conn.

[21] Appl. No.: 08/948,143

[22] Filed: Oct. 9, 1997

[51] Int. Cl.[6] ..... B25D 1/00

[52] U.S. Cl. ..... 81/20; 403/267; 403/277; 76/103

[58] Field of Search ..... 81/20, 22; 403/263, 403/267–269, 277; 16/110 R, 116 R; 76/103

[56] References Cited

U.S. PATENT DOCUMENTS

| | | | |
|---|---|---|---|
| 1,194,170 | 8/1916 | Grossmann . | |
| 2,067,751 | 1/1937 | Beegle | 81/22 X |
| 2,467,284 | 4/1949 | Williams . | |
| 2,831,202 | 4/1958 | Lay | 81/20 X |
| 2,837,381 | 6/1958 | Sarlandt . | |
| 2,884,969 | 5/1959 | Lay . | |
| 2,983,296 | 5/1961 | Lay . | |
| 3,175,232 | 3/1965 | Stowell . | |
| 3,660,887 | 5/1972 | Davis . | |
| 3,672,712 | 6/1972 | Davis . | |
| 3,877,826 | 4/1975 | Shepherd, Jr. et al. . | |
| 3,879,145 | 4/1975 | Carmien et al. . | |
| 4,089,356 | 5/1978 | O'Connor . | |
| 4,144,919 | 3/1979 | Miller . | |
| 4,291,998 | 9/1981 | Santos . | |
| 4,331,193 | 5/1982 | Tudisco . | |
| 4,334,563 | 6/1982 | Epel et al. . | |
| 4,404,708 | 9/1983 | Winter . | |
| 4,683,784 | 8/1987 | Lamont . | |
| 5,237,735 | 8/1993 | Grossmann . | |
| 5,259,274 | 11/1993 | Hreha . | |

*Primary Examiner*—D. S. Meislin
*Attorney, Agent, or Firm*—Pepe & Hazard LLP

[57] ABSTRACT

A hand-held striking tool has a striking head having an eye passage of generally rectangular cross section a portion adjacent one end thereof enlarged along one transverse axis. Seated in the eye passage is an elongated handle with a metallic core rod of generally I-shaped cross section with a longitudinally extending notch in the web portion at one end providing a bifurcated end portion which has its legs inclined outwardly to a transverse dimension greater than that of the other end of the eye passage. A sleeve of synthetic resin is provided about the core rod adjacent the head and extends over a portion of the length of the eye passage. Synthetic resin fills the eye passage about the core rod.

15 Claims, 3 Drawing Sheets

HAMMER WITH IMPROVED HANDLE INTERLOCK AND METHOD OF MAKING SAME

BACKGROUND OF THE INVENTION

The present invention relates to hand tools and, more particularly, to hand-held striking tools such as hammers and the like and to a method for securing the head and handles in assembly.

Striking tools such as hammers, axes and picks generally have a forged metal head with an eye passage extending therethrough and into which the handle is inserted. Various techniques have been used for securing the handle in the eye of the head such as, for example, metal wedges driven into the end of a wooden handle to spread or expand the end portion of the handle into firm frictional engagement with the head.

In recent years, composite handles employing a metallic core rod and a surrounding synthetic resin jacket have become quite popular because of their durability and balance. Exemplary of such tools is the hammer disclosed in Hreha U.S. Pat. No. 5,259,274 granted Nov. 9, 1993.

Various techniques have been proposed for securing the end of such a composite handle in the eye of the head with the most common being the encasement of the end portion of the handle end in the eye with a rigid high strength resin such as an epoxy resin. Unfortunately, repeated striking of the hammer head and the attendant vibrations, with differentials in thermal expansion of the handle, resin, rod, and head, will over a period of time tend to produce some weakening of the bond between the epoxy and the head and handle end portion. Under some circumstances, sufficient axial forces can result in the handle being pulled from the eye of the striking head.

Accordingly, it is an object of the present invention to provide a novel hand-held striking tool in which the core rod of the handle is securely engaged within the eye passage in the striking head.

It is also an object to provide such a striking tool the metallic core rod is deformed into mechanical engagement with the eye passage.

Another object is to provide such a striking tool which can be fabricated readily and which is long lived.

A still further object is to provide a novel method for assembling a handle having a core rod with a striking tool head.

SUMMARY OF THE INVENTION

It has now been found that the foregoing and related objects may be readily attained in a hand-held striking tool comprising a striking head having an eye passage of generally rectangular cross section extending therethrough with the portion adjacent one end thereof enlarged along one transverse axis. Disposed in the eye passage is an elongated handle which has a metallic core rod of generally I-shaped cross section provided by end flanges and a web portion. The core rod has its one end extending into the enlarged portion of the eye passage and has a longitudinally extending notch in its web portion at the one end providing a bifurcated end portion. The core rod is oriented in the eye passage with the web portion extending along the enlarged transverse axis. The legs of the bifurcated end portion are angled outwardly upwardly in the one transverse direction to a transverse dimension greater than that of the other end of the eye passage, and synthetic resin fills the eye passage about the core rod. A sleeve of synthetic resin extends about the core rod adjacent the head and over a portion of the length of the eye passage.

Preferably, the core rod has recesses along the edges of the notch and the edges are undulated to provide the recesses. The eye passage cross section has a major axis and a minor axis, and the enlarged transverse axis is the major axis. The legs provided by the bifurcated end portion of the core rod are expanded into contact with the surface of the head defining the eye passage.

Desirably, the core rod is spaced inwardly from the one end of the eye passage and the synthetic resin extends thereover. The portion of the sleeve disposed in the eye passage has a circumferential groove thereabout and axial grooves extending from the one end to the circumferential groove. The synthetic resin not only fills the eye passage but also extends into the grooves.

In assembling the tool, a wedge is driven into the notch to spread the legs of the bifurcated end portion.

DETAILED DESCRIPTION OF THE PREFERRED EMBODIMENT

Figure 1:
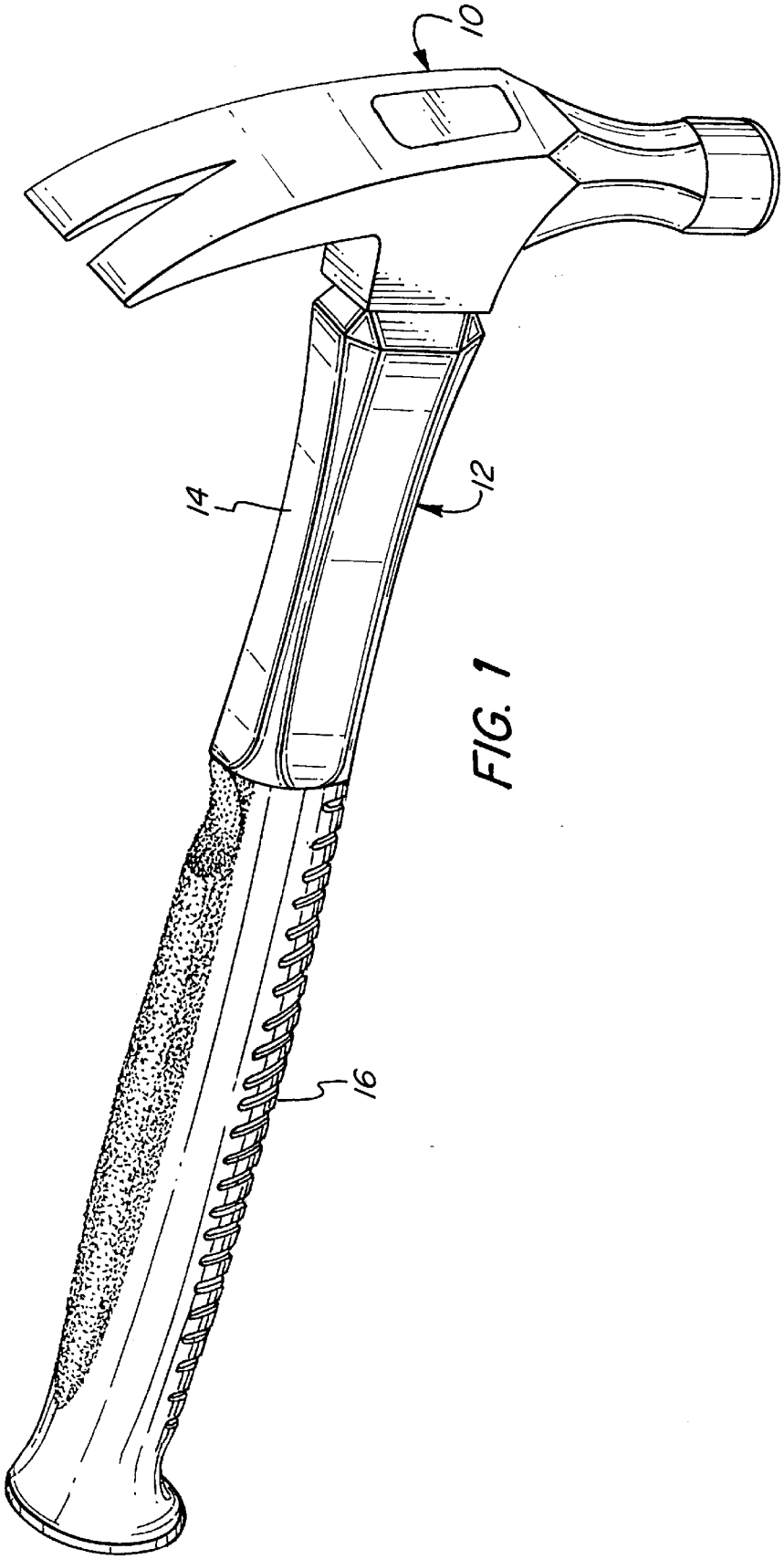
FIG. 1 is an elevational view of a hammer embodying the present invention.

Turning first to FIG. 1, therein illustrated is a claw hammer embodying the present invention and generally comprised of a striking head generally designated by the numeral 10 and a handle generally designated by the numeral 12. As seen in FIG. 1, the handle has a sleeve 14 extending about the upper portion thereof and a grip 16 of relatively soft resin extending about the lower portion thereof.

Figure 2:
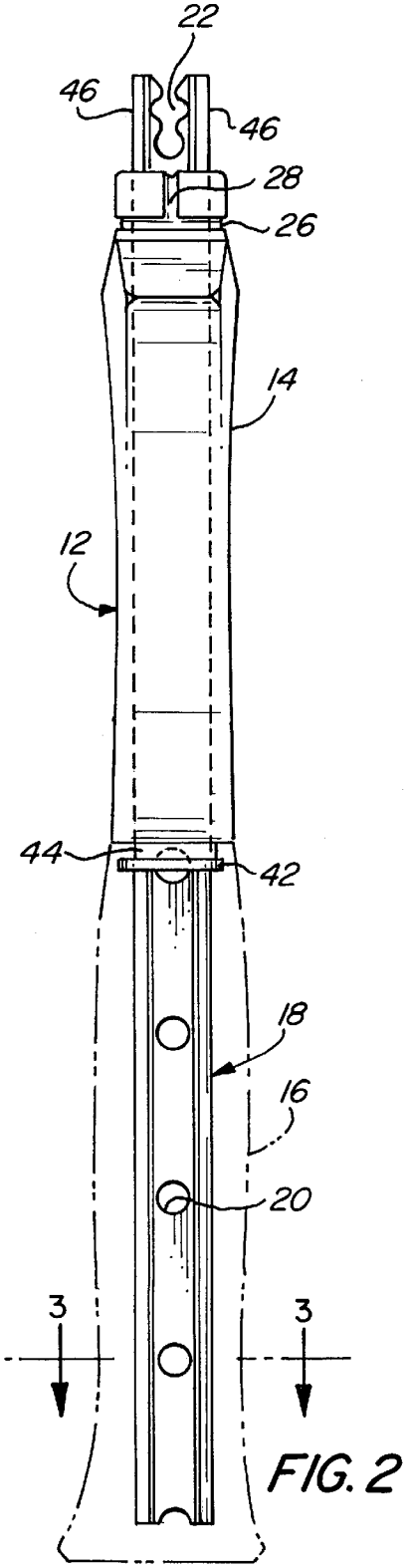
FIG. 2 is an elevational view of the handle with the grip portion shown in phantom line.
Figure 4:
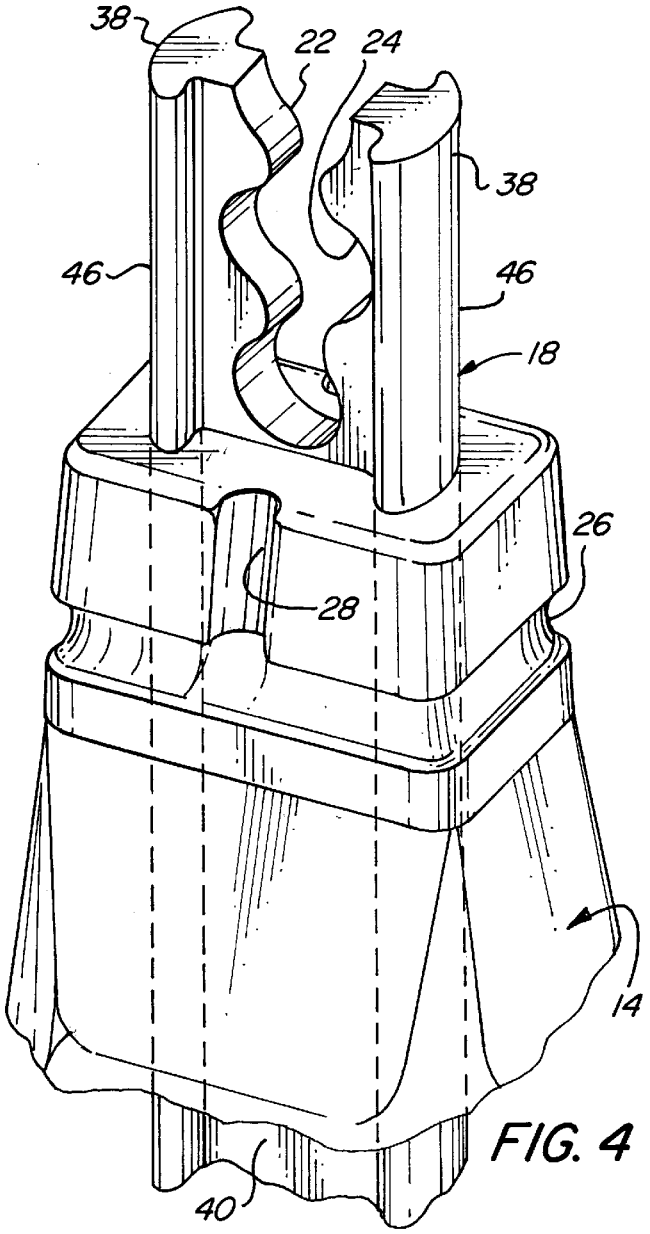
FIG. 4 is a fragmentary perspective view of the upper portion of the handle drawn to an enlarged scale and with a portion of the sleeve broken away.
Figure 3:
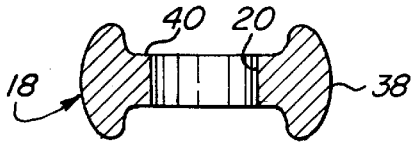
FIG. 3 is a sectional view of the core rod along the line 3—3 of FIG. 2 and drawn to an enlarged scale.

As seen in FIGS. 2–4, the handle 12 has a core rod generally designated by the numeral 18 and having generally I-shaped cross section with arcuately contoured flanges 38 and a web 40 extending therebetween. The web 40 has apertures 20 extending therethrough at spaced points along its length and a notch 22 is formed at its upper end with the undulating edges defining the notch providing arcuate recesses 24. The notch 22 produces a bifurcated end portion with a pair of legs 46.

As can be seen, the sleeve 14 is spaced inwardly from the upper end of the core rod 18 and is molded with a peripheral groove 26 extending thereabout and axial grooves 28 extending thereinto from its upper end. At its lower end, the sleeve 14 has a peripheral groove 44 and a collar 42 extending thereabout so that when the grip 16 is molded over the lower end of the core rod 18, it will extend over the collar 42 and inwardly of the groove 44 so as to provide secure engagement therewith.

Figure 5:
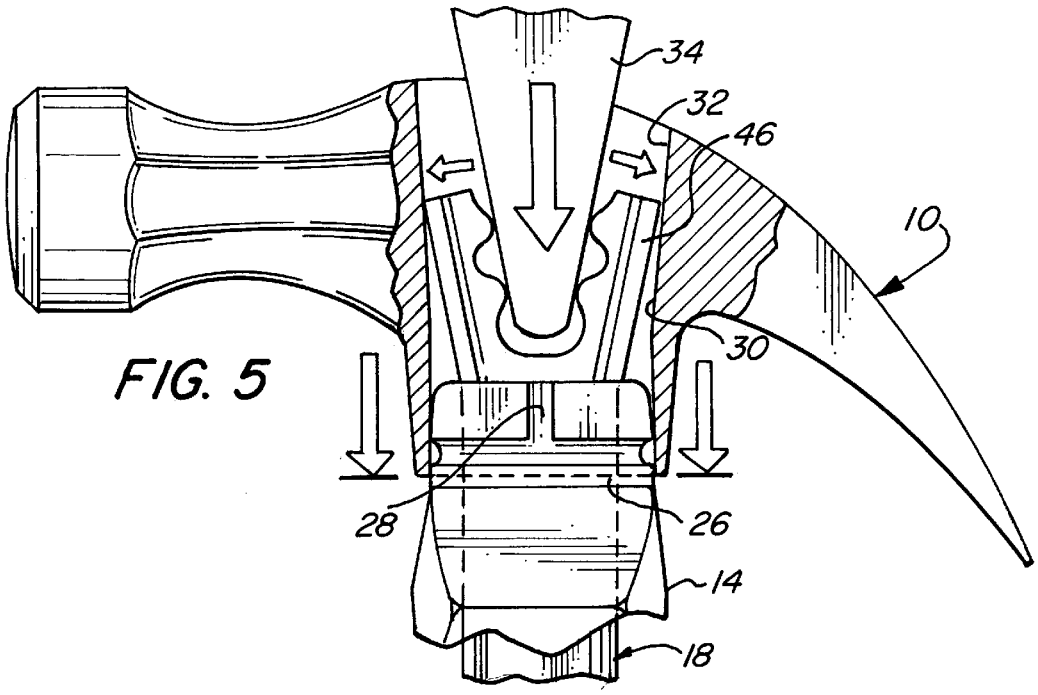
FIG. 5 is a partially diagrammatic view of the upper portion of the hammer showing a wedge spreading the upper portion of the core rod.
Figure 6:
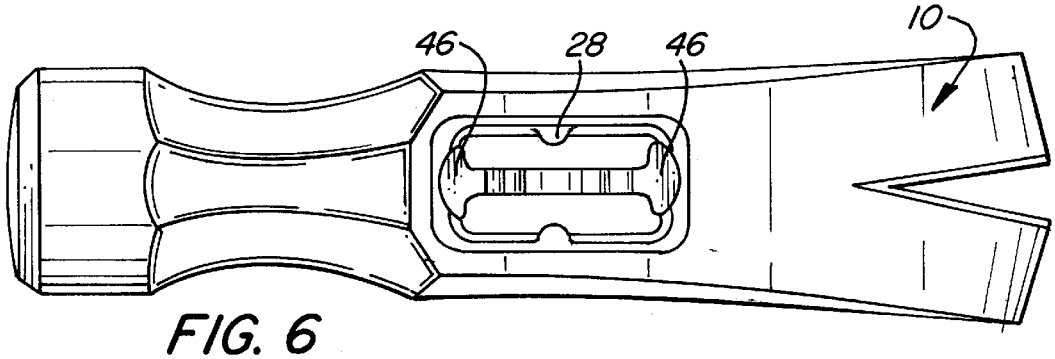
FIG. 6 is a top view of the hammer of FIG. 5 after the wedge has been withdrawn.
Figure 7:
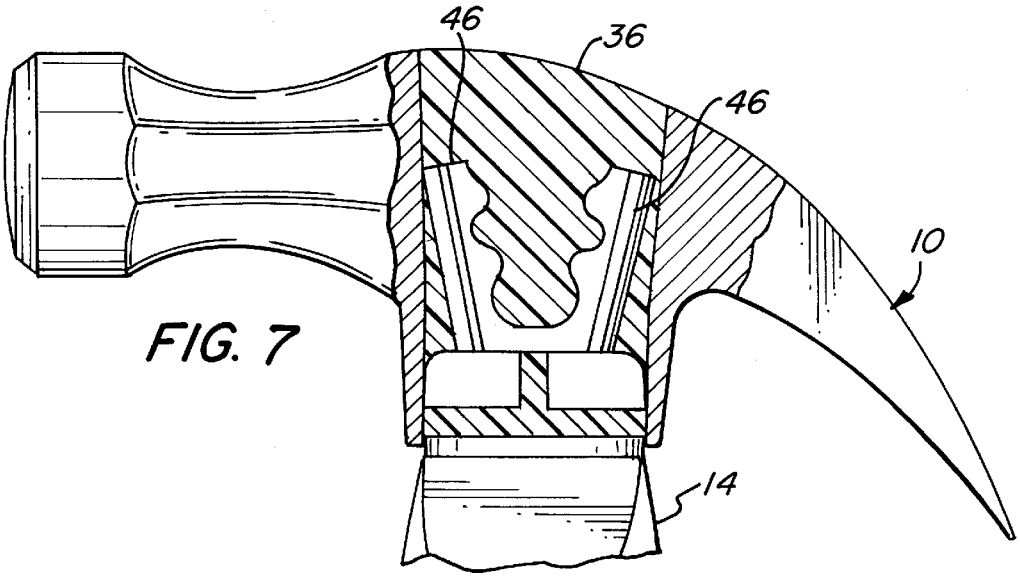
FIG. 7 is a view similar to FIG. 5 after synthetic resin has been introduced into the eye of the hammer head to completely encase the core rod and secure the handle in assembly.

Turning now to FIGS. 5–7, the hammer head 10 has an eye passage generally designated by the numeral 30 with a generally rectangular cross section having a major axis and a minor axis. The lower end of the eye passage 30 is of uniform dimension over its length and the upper portion 32 has its longitudinally oriented end walls tapering upwardly outwardly to provide a larger dimension along the major axis. As can be seen, the upper portion of the sleeve 14 seats in the lower portion of the head eye passage 30 and is in sealing engagement therewith.

To effect permanent assembly to the handle 12 to the head 10, a wedge 34 is inserted into the notch 22 and driven with sufficient force to deform the legs 46 of the bifurcated upper end portion of the core rod 18 as shown in FIG. 5 into a position in which the flanges 38 abut the end walls of the eye passage 30 as seen in FIG. 6.

After removal of the wedge, a high strength synthetic resin such as an epoxy resin 36 is poured into the cavity provided by the eye passage 30 and flows about the core rod 18 and through the axial grooves 28 into the peripheral groove 26. Upon hardening of the resin, the handle 12 is now firmly engaged in the hammer head. Because the bifurcated end of the core rod 18 is now larger in dimension than the lower portion of the eye passage 30 as well as the resistance presented by the bond of the resin to the head 10 itself, the handle 12 is firmly retained even against pressures which would tend to draw the handle 12 outwardly of the lower portion of the head 10.

As previously indicated, the resin utilized in the eye of the head is a high strength epoxy resin. The resin employed for the sleeve is desirably a durable synthetic resin such as the ionomer resin sold by DuPont under the trademark SURLYN. The grip is conveniently provided by a soft plasticized polyvinyl chloride.

In assembling the hammer, the sleeve portion is first molded about the core rod. Thereafter, the grip portion is molded about the lower portion of the core rod and of the sleeve so that it interlocks with the sleeve as indicated hereinbefore. The handle is then inserted into the eye of the head in a suitable jig and a wedge is driven into the bifurcated end portion to spread the legs apart and force them tightly against the ends of the eye passage. The wedge is then withdrawn and the epoxy resin is then introduced into the open end of the eye so that it flows downwardly into the grooves in the upper portion of the sleeve. Upon curing, the assembly is now complete.

The process of forming the head will generally produce a rough surface in the eye passage. This rough surface also produces an interlocking between the epoxy resin and the surface of the handle to produce a mechanical bond in addition to the adhesive bond.

In addition to the mechanical locking illustrated, there is a large amount of epoxy cross sectional area. This gives a larger "shear plane", and greater pull performance. In fact, we have been getting a fairly consistent 3,600 pound average pull with this design modification.

Thus, it can be seen from the foregoing detailed specification and attached drawings, that the striking tool of the present invention is one in which a handle having a core rod is firmly bonded to the striking head. The components may be readily fabricated and assembled to provide a long lived structure.

Having thus described the invention, what is claimed is:

1. A hand-held striking tool comprising:

(a) a striking head having an eye passage of generally rectangular cross section extending therethrough with the portion adjacent one end thereof enlarged in one transverse axis;

(b) an elongated handle having one end disposed in said eye passage and having (i) a metallic core rod of generally I-shaped cross section provided by end flanges and a web portion, said core rod having its one end extending into said enlarged portion of said eye passage and having a longitudinally extending notch in said web portion at said one end to provide a bifurcated end portion, said core rod being oriented in said eye passage with said web portion extending along said enlarged transverse axis the legs of said bifurcated end portion being angled outwardly in said one transverse direction to a transverse dimension greater than that of said other end of said eye passage, and (ii) a sleeve of synthetic resin about said core rod adjacent said head and extending over a portion of the length of said eye passage; and (c) synthetic resin filling said eye passage about said core rod.

2. The hand-held striking tool in accordance with claim 1 wherein said core rod has recesses along the edges of said notch.

3. The hand-held striking tool in accordance with claim 2 wherein said notch has undulating edges providing said recesses.

4. The hand-held striking tool in accordance with claim 1 wherein said one end of said core rod is expanded into contact with the surface of said head defining said eye passage.

5. The hand-held striking tool in accordance with claim 1 wherein said core rod is spaced inwardly from said one end of said eye passage and said synthetic resin extends thereover.

6. The hand-held striking tool in accordance with claim 1 wherein said eye passage cross section has a major axis and a minor axis and wherein said enlarged transverse axis is said major axis.

7. The hand-held striking tool in accordance with claim 1 wherein the portion of said sleeve disposed in said eye passage has a circumferential groove thereabout and axial grooves extending from said one end to said circumferential groove, and wherein said synthetic resin filling said eye passage extends into said grooves.

8. In the method of making a striking tool, the steps comprising:

(a) forming a notch in one end of a metallic core rod having a generally I-shaped cross section provided by end flanges and a web portion;

(b) forming a striking tool head with an eye passage therethrough with the portion adjacent one end of said passage being enlarged in one transverse axis;

(c) inserting said one end of said core rod into the other end of said eye passage in said head to position said one end in said enlarged portion of said eye passage;

(d) driving a wedge into said notch to expand said one end of said core rod in said one transverse direction to a transverse dimension greater than that of said other end of said eye passage; and (e) filling said eye passage about said core rod with a synthetic resin.

9. The method of making a striking tool in accordance with claim 8 wherein said core rod forming step produces recesses along the edges of said notch.

10. The method of making a striking tool in accordance with claim 9 wherein said core rod forming step produces a notch with undulating edges providing said recesses.

11. The method of making a striking tool in accordance with claim 8 wherein said expanding step expands said one end of said core rod into contact with the surface of said head defining said eye passage.

12. The method of making a striking tool in accordance with claim 8 wherein said core rod inserting step spaces said one end of said rod inwardly from said one end of said eye passage, and wherein filling step deposits said synthetic resin thereover.

13. The method of making a striking tool in accordance with claim 8 wherein head forming step produces said eye passage cross section with a major axis and a minor axis and wherein said enlarged transverse axis is said major axis.

14. The method of making a striking tool in accordance with claim 8 wherein there is included the step of forming a sleeve of synthetic resin about said core rod spaced from said one end thereof and wherein said inserting step positions a portion of said sleeve in a portion of said eye passage adjacent said other end thereof.

15. The method of making a striking tool in accordance with claim 14 wherein said sleeve portion positioned in said eye passage has a circumferential groove thereabout and axial grooves extending from said one end to said circumferential groove, and wherein said filling step causes said synthetic resin to extend into said grooves.

* * * * *